US009470410B2

(12) United States Patent
Hartmann et al.

(10) Patent No.: US 9,470,410 B2
(45) Date of Patent: Oct. 18, 2016

(54) ARRANGEMENT OF A HEAT SINK AND HEAT-GENERATING ELECTRONIC COMPONENTS HOUSED THEREON

(71) Applicant: Diehl Aerospace GmbH, Ü berlingen (DE)

(72) Inventors: Matthias Hartmann, Feucht (DE); Uwe Wolff, Forchheim (DE); Sebastian Sicker, Nürnberg (DE)

(73) Assignee: DIEHL AEROSPACE GMBH, Uberlingen (DE)

( * ) Notice: Subject to any disclaimer, the term of this patent is extended or adjusted under 35 U.S.C. 154(b) by 260 days.

(21) Appl. No.: 14/104,115

(22) Filed: Dec. 12, 2013

(65) Prior Publication Data

US 2014/0168980 A1 Jun. 19, 2014

(30) Foreign Application Priority Data

Dec. 14, 2012 (DE) ..... 10 2012 024 459

(51) Int. Cl.

| | |
|---|---|
| ***F21V 29/85*** | (2015.01) |
| ***F21V 29/74*** | (2015.01) |
| *F21V 19/00* | (2006.01) |
| *F21Y 101/02* | (2006.01) |
| *F21V 29/87* | (2015.01) |
| *F21V 29/89* | (2015.01) |

(52) U.S. Cl.

CPC ..... *F21V 29/85* (2015.01); *F21V 29/74* (2015.01); *F21V 19/0055* (2013.01); *F21V 29/86* (2015.01); *F21V 29/87* (2015.01); *F21V 29/89* (2015.01); *F21Y 2101/02* (2013.01)

(58) Field of Classification Search

CPC ..... F21V 29/70; F21V 29/85; F21V 29/87; F21V 29/503

See application file for complete search history.

(56) References Cited

U.S. PATENT DOCUMENTS

| | | | | |
|---|---|---|---|---|
| 2009/0154166 | A1 | 6/2009 | Zhang et al. | |
| 2009/0262542 | A1 | 10/2009 | Li et al. | |
| 2011/0095690 | A1* | 4/2011 | Sagal | B29C 45/14 315/113 |
| 2012/0307501 | A1* | 12/2012 | Tankala | F21K 9/90 362/294 |

FOREIGN PATENT DOCUMENTS

| | | | |
|---|---|---|---|
| DE | 102007028097 | A1 | 12/2008 |
| DE | 102011087224 | A1 | 5/2013 |

OTHER PUBLICATIONS

English Abstract only of EP 2596987 A2, dated May 29, 2013.

* cited by examiner

*Primary Examiner* — Julie Bannan

(74) *Attorney, Agent, or Firm* — Scully Scott Murphy and Presser

(57) ABSTRACT

An arrangement of a heat sink and a heat-generating electronic component is provided. The heat sink has a main part and a moulding of plastic. The electronic component is mounted on a first surface of the main part with thermal contact to the main part. The moulding is mounted to a second surface of the main part, opposite the first surface, to provide structural strength to the arrangement. The moulding has a void provided through the moulding. As a result, once the moulding and the main part are mounted to each other, a portion of the second surface of the main part is exposed through the void.

17 Claims, 5 Drawing Sheets

ARRANGEMENT OF A HEAT SINK AND HEAT-GENERATING ELECTRONIC COMPONENTS HOUSED THEREON

BACKGROUND OF THE INVENTION

The invention is directed to an arrangement of a heat sink and heat-generating electronic components housed thereon. In particular, it relates to an LED light for use in a passenger aircraft.

DISCUSSION OF THE PRIOR ART

According to the state of the art, arranging heat-generating electronic components on a heat sink produced from extrusion-moulded aluminium is known. Aluminium heat sinks have the effect of dissipating heat from electronic components. Furthermore, fitting interfaces are provided, giving the arrangement structural strength. Aluminium heat sinks embody a comparably high weight and are more expensive to produce.

SUMMARY OF THE INVENTION

The task of the invention is to remove the disadvantages according to the state of the art. In particular, such an arrangement is to be declared embodying a low weight and which is economical to produce.

According to the invention, a heat sink is provided comprising a main part and a plastic moulding. An electronic component is arranged on a first surface of the main part with thermal contact to the main part. The moulding is mounted to a second surface of the main part, opposite the first surface, to provide structural strength of the arrangement. The moulding has a void provided through the moulding. As a result, once the moulding and the main part are mounted to each other, a portion of the second surface of the main part is exposed through the void. Together with the moulding, the main part forms a hybrid body.

By providing a moulding with first fitting interfaces, the main part can be designed without fitting interfaces. Therefore, the main part can be of smaller construction, thus saving weight. Furthermore, for example, chip-removal type machining can be avoided in the production of the main part. The production of the main part can be done more economically.

The main part may embody a thermal conductivity of more than 10 W/(m·K). Preferably, the main part may embody a thermal conductivity of more than 100 W/(m·K) and particularly preferably of more than 200 W/(m·K). Thus heat can be dissipated effectively from the electronic components. In particular, metals, ceramics and thermally-conductive plastics are considered as materials for the main part. The main part can be provided with a surface coating.

According to an advantageous embodiment, the main part comprises at least one metal part. The heat generated by the electronic components can be effectively dissipated by means of the metal part and the arrangement can simultaneously provide good structural strength.

The metal part may be a sheet, an extruded section or a die casting. According to an advantageous embodiment, the metal part is produced from aluminium. As a light metal, aluminium is particularly suitable for use in aviation.

The electronic components may be housed on a board, which is fitted on the first side. In particular, the electronic components may be light-emitting diodes. Thus, the arrangement in accordance with the invention assumes the dissipation of the heat generated by the light-emitting diodes when they are in operation.

The main part may embody two fitting interfaces. The first and second fitting interfaces may embody correspondingly arranged and formed perforations, so that fastenings may also extend through both perforations. By means of the fastenings, for example, a board can be fastened to the heat sink.

The first fitting interfaces may also comprise snap hooks. The snap hooks may be engageable in a counterpart located on the first side. The counterpart may be a lens holder or lens able to be arranged on the board.

The first fitting interfaces on the moulding may also enable a fastening of the arrangement to a frame structure.

The moulding may encompass two opposite edges of the advantageously flat-shaped main part. For example, the moulding may be produced in an injection moulding process by using a thermoplastic polymer.

A liquid crystal polymer may be used as the polymer. Liquid crystal polymers (LCP) are characterised by a high tensile strength, a high modulus of elasticity and a high melting point.

The thermal expansion coefficients of the main part and the moulding are advantageously adapted to each other. This avoids stresses due to thermal effects or a crack between the moulding and main part.

According to the scope of the invention, an LED light is also proposed, in which on the first side of the heat sink described above, a board equipped with light-emitting diodes is fitted. With the proposed LED light, the heat generated can be effectively dissipated, even at high illumination intensities. The proposed LED light is also characterised by a small construction size, a low weight and economical production.

In accordance with an advantageous embodiment, with the proposed LED light, the board can be fastened to the heat sink with self-tapping screws. In this case it is not necessary to tap a thread beforehand in a separate process.

BRIEF DESCRIPTION OF THE DRAWINGS

In the following, embodiments of the invention are explained in more detail using the drawings, in which.

DETAILED DESCRIPTION OF THE INVENTION

Figure 1:
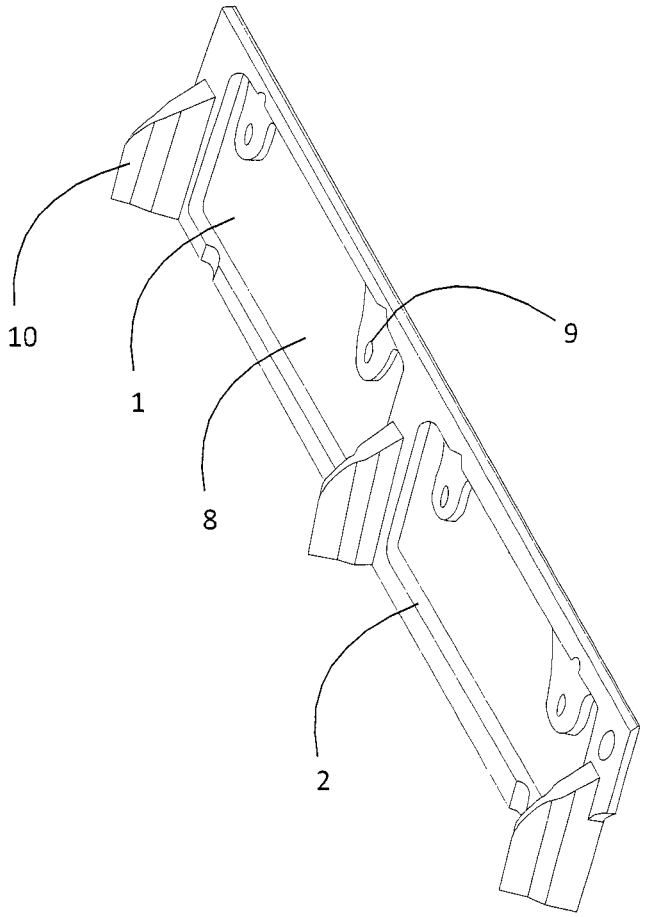
FIG. 1 shows a perspective view of a first heat sink.
Figure 2:
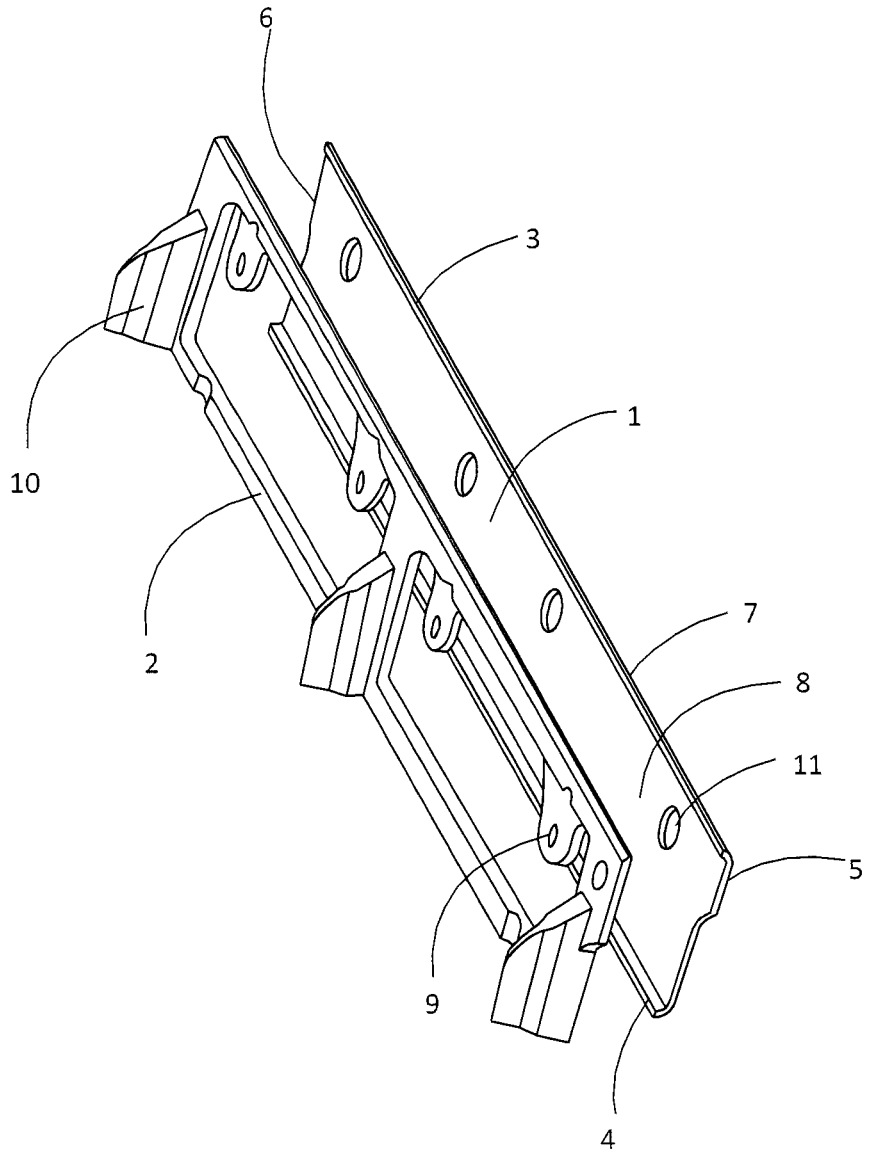
FIG. 2 shows a perspective view of the heat sink according to FIG. 1 in an exploded view.

The first heat sink shown in FIG. 1 and FIG. 2 comprises a main part 1 and a moulding 2. The main part 1 consists of an essentially rectangular metal plate made of injection-moulded aluminium with two opposite long edges 3, 4 and two opposite short edges 5, 6 and a first side 7 and a second side 8. The moulding 2 is produced by moulding around the main part 1 with a thermoplastic polymer in an injection moulding process. The long edges 3, 4 and short edges 5, 6 of main part 1 are completely surrounded by the moulding. The long edges 3, 4 embody a bend in the direction of the second side 8. The first side 7 of the main part 1 is free of the moulding, apart from its edge area. Sections of the second side 8 of the main part 1 are covered by the first fitting interfaces formed on the moulding.

The first fitting interfaces are shown here as rings embodying the first perforations 9 and as ribs 10. Corresponding to the first perforations 9, the main part 1 embodies second fitting interfaces formed as second perforations 11. The first 9 and second perforations 11 are provided in corresponding positions on the moulding 2 and on the main part 1, in such a way that the fastenings 14 shown in FIG. 5 can extend through the first 9 and second perforations 11.

The ribs 10 of the moulding 2 protrude somewhat vertically from the second side 8 of the main part 1. The ribs 10 embody blind holes (not shown here). Further fastenings (not shown) for fastening the first heat sink may engage into the blind holes to a frame structure not shown in FIG. 1 and FIG. 2.

Figure 3:
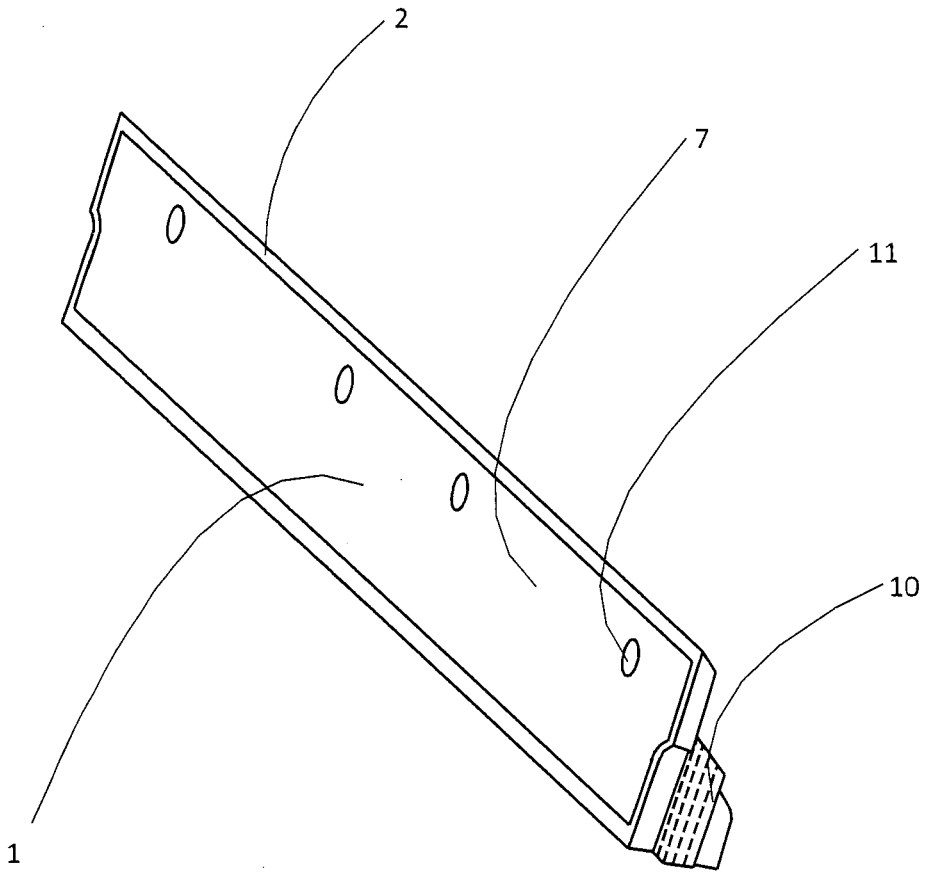
FIG. 3 shows a perspective view of a second heat sink.
Figure 4:
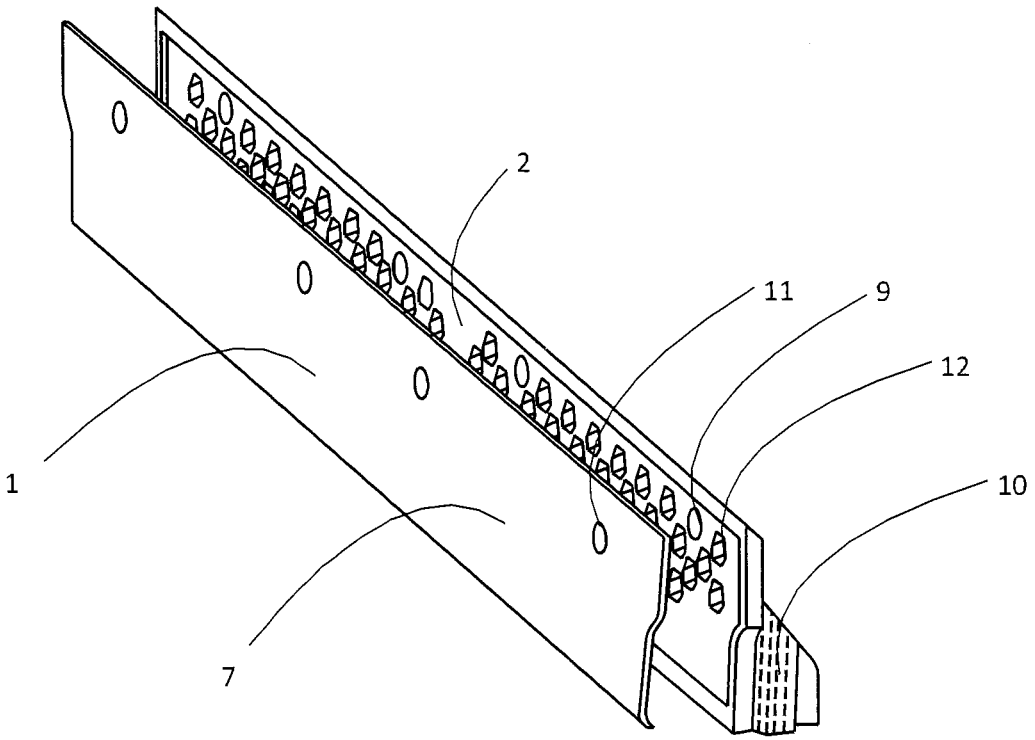
FIG. 4 shows a perspective view of the heat sink according to FIG. 3 in an exploded view and FIG. 5 shows a perspective view of an LED light.

The second heat sink shown in FIG. 3 and FIG. 4 corresponds to the first heat sink with the difference that in the second heat sink, the moulding 2 extends over the second side 8 of the main part 1. The moulding 2 embodies a number of further perforations 12 here. The further perforations 12 enable a heat dissipation from the main part 1.

Figure 5:
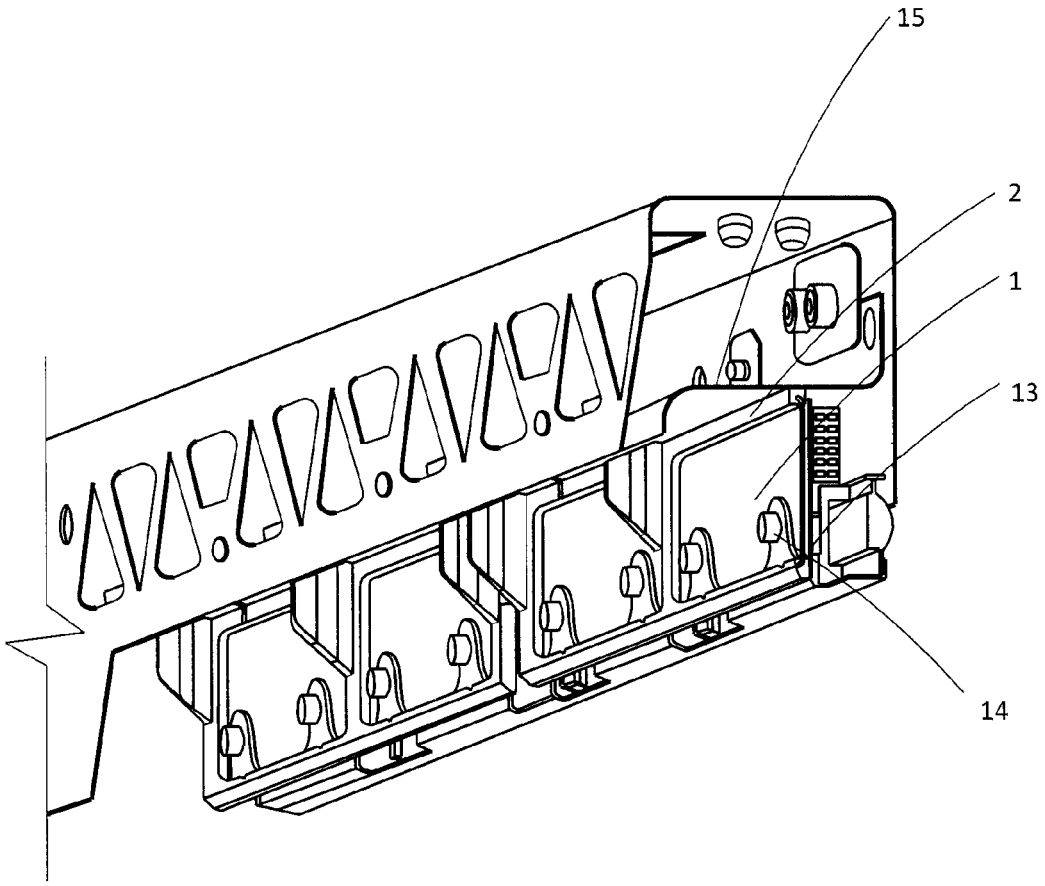

FIG. 5 shows a perspective view of an LED light. The LED light comprises the first heat sinks with main part 1 and moulding 2. On the first side 7 of the main part 1, a board 13 equipped with light-emitting diodes is fitted by means of fastenings 14, which board extends through the first 9 and second perforations 11. The fastenings 14 are, for example, self-tapping screws.

The arrangement in accordance with the invention is fastened to a frame structure 15 by means of a further unnoticeable fastening in FIG. 5. The further fastenings engage into the blind holes provided in the ribs 10. The further fastenings are, for example, self-tapping screws.

In the following, the function of the arrangement in accordance with the invention is explained in more detail. Main part 1 is used to dissipate the heat generated by the light-emitting diodes in operation and provides the structural strength of the arrangement. The moulding 2 is used to provide first and second fitting interfaces.

By providing the moulding 2, fewer functions are provided by the main part 1. This enables the main part 1 to be constructed more simply, thus saving weight. Production is more economical.

LIST OF REFERENCE SYMBOLS

1 Main part
2 Moulding
3 First long edge
4 Second long edge
5 First short edge
6 Second short edge
7 First side
8 Second side
9 First perforations
10 Ribs
11 Second perforations
12 Other perforations
13 Board
14 Fastenings
15 Frame structure

What is claimed is:

1. An arrangement comprising a heat sink and a heat-generating electronic component mounted to the heat sink, wherein the heat sink comprises a main part and a moulding of plastic;

wherein the main part comprises a first surface and an opposite second surface;

wherein the electronic component is mounted to the first surface to allow heat generated by the electronic component to dissipate through the main part;

wherein the moulding comprises a first fitting interface and the main part comprises a second fitting interface provided on the second surface of the main part, wherein the moulding is mounted to the main part through engagement of the first fitting interface and the second fitting interface to provide structural strength to the arrangement; and wherein the moulding comprises at least one void provided through the moulding, such that at least a portion of the second surface of the main part is exposed through the void after the moulding and the main part are mounted to each other, wherein the first fitting interface comprises a first perforation and the second fitting interface comprises a second perforation and wherein a fastener is provided to extend through the first perforation and the second perforation to engage the first fitting interface and the second fitting interface.

2. The arrangement according to claim 1, wherein the main part has a thermal conductivity of more than 10 W/(m·K).

3. The arrangement according to claim 1, wherein the main part has a thermal conductivity of more than 100 W/(m·K).

4. The arrangement according to claim 1, wherein the main part has a thermal conductivity of more than 200 W/(m·K).

5. The arrangement according to claim 1, wherein the main part comprises at least one metal part.

6. The arrangement according to claim 5, wherein the metal part comprises at least one of a sheet, an extruded section and a die casting.

7. The arrangement according to claim 5, wherein the metal part is produced from aluminium.

8. The arrangement according to claim 1, wherein the at least one electronic component is provided on a board, which is fitted on the first surface of the main part.

9. The arrangement according to claim 1, wherein the at least one electronic component comprises light-emitting diodes.

10. The arrangement according to claim 1, wherein the second fitting interface of the main part comprises two fitting interfaces.

11. The arrangement according to claim 1, wherein the first fitting interface comprises snap hooks.

12. The arrangement according to claim 1, wherein the main part has two opposite edges and wherein the moulding surrounds the two opposite edges of the main part.

13. The arrangement according to claim 1, wherein the moulding comprises a thermoplastic polymer.

14. The arrangement according to claim 13, wherein said thermoplastic polymer is a liquid crystal polymer.

15. An LED light comprising the arrangement according to claim 1, wherein the first surface of the heat sink is fitted with a board equipped with light-emitting diodes.

16. The LED light according to claim 15, wherein the board is fastened to the heat sink with self-tapping screws.

17. An LED light comprising an arrangement, said arrangement comprising a heat sink and a heat-generating electronic component mounted to the heat sink, wherein the heat sink comprises a main part and a moulding of plastic;

wherein the main part comprises a first surface and an opposite second surface;

wherein the electronic component is mounted to the first surface to allow heat generated by the electronic component to dissipate through the main part;

wherein the moulding comprises a first fitting interface and the main part comprises a second fitting interface provided on the second surface of the main part, wherein the moulding is mounted to the main part through engagement of the first fitting interface and the second fitting interface to provide structural strength to the arrangement;

wherein the moulding comprises at least one void provided through the moulding, such that at least a portion of the second surface of the main part is exposed through the void after the moulding and the main part are mounted to each other;

wherein the first surface of the heat sink is fitted with a board equipped with light-emitting diodes; and wherein the board is fastened to the heat sink with self-tapping screws.

* * * * *